United States Patent [19]

Riel

[11] Patent Number: 5,024,373

[45] Date of Patent: Jun. 18, 1991

[54] CONTAINER FOR PULVERIZED AND GRANULAR PRODUCTS, SUCH AS MEDICINES

[75] Inventor: Leslie L. Reid, Van Alkemadelaan 1056,2597 BJ, The Hague, Netherlands

[73] Assignees: Leslie L. Riel; Hendrik van der Tak; Shafiq M. Ghafoerkhan; Power Pack International B.V. i.o., all of The Hague, Netherlands

[21] Appl. No.: 495,423

[22] Filed: Mar. 19, 1990

[51] Int. Cl.[5] ..... B65D 27/14

[52] U.S. Cl. ..... 229/68 R; 229/69; 229/87.5

[58] Field of Search ..... 229/68 R, 1.5 B, 75, 229/69, 87.01, 87.03, 87.5, 8; 383/37, 84, 906; 150/153

[56] References Cited

U.S. PATENT DOCUMENTS

| | | | |
|---|---|---|---|
| 1,980,953 | 11/1934 | Kilmer | 383/84 X |
| 2,671,602 | 3/1954 | Vogt | 383/37 |
| 3,848,356 | 11/1974 | Wylie et al. | 229/68 R X |

FOREIGN PATENT DOCUMENTS

| | | | |
|---|---|---|---|
| 98764 | 9/1897 | Fed. Rep. of Germany | 229/87.01 |
| 10602 | 9/1902 | Fed. Rep. of Germany | 229/68 |
| 263666 | 10/1927 | Italy | 229/87.5 |
| 58429 | 12/1911 | Switzerland | 229/8 |
| 365001 | 1/1932 | United Kingdom | 383/84 |
| 662592 | 12/1951 | United Kingdom | 229/87.5 |

*Primary Examiner*—Gary E. Elkins
*Assistant Examiner*—Jes F. Pascua
*Attorney, Agent, or Firm*—Beveridge, DeGrandi & Weilacher

[57] ABSTRACT

Container made up like an envelope, obtained by folding a stamped blank of paper or similar material and comprising: a front sheet; a back sheet connected therewith by means of a first folding line; a flap connected with the front sheet by means of a second folding line which runs parallel to the first folding line, said flap at least partly overlapping the back sheet; and side strips which are connected with the front sheet by means of longitudinal folding lines perpendicular to said first folding lines, the edges of the back sheet being adhered thereto by means of a permanent gum path. In order to enable pouring out pulverized or granular products, the front and back sheets (1, 2) are substantially of the same size, and comprise two pairs of crease lines (13), which, after manufacturing the envelope, substantially extend from the center (14) of the second folding line (8) to the points of intersection (15) of the first folding line (7) with the longitudinal folding lines (6).

8 Claims, 2 Drawing Sheets

CONTAINER FOR PULVERIZED AND GRANULAR PRODUCTS, SUCH AS MEDICINES

Figure 1:
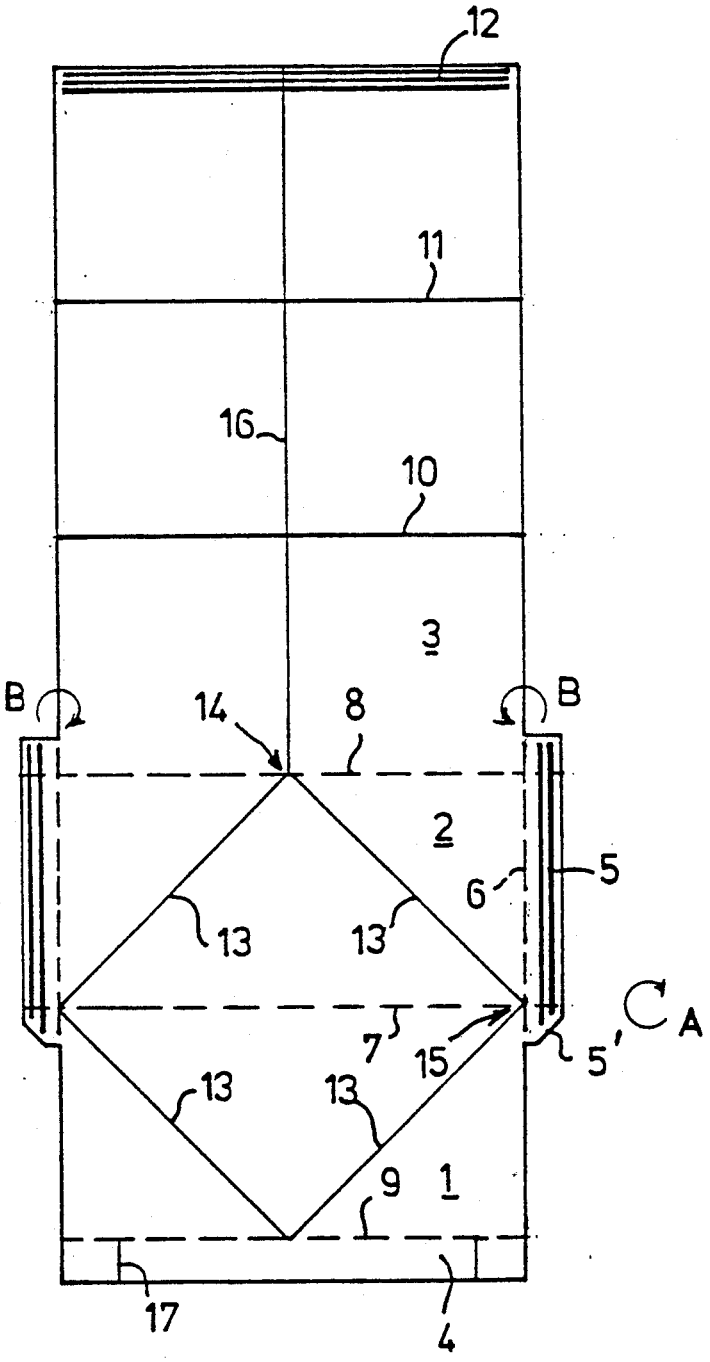
Figure 2:
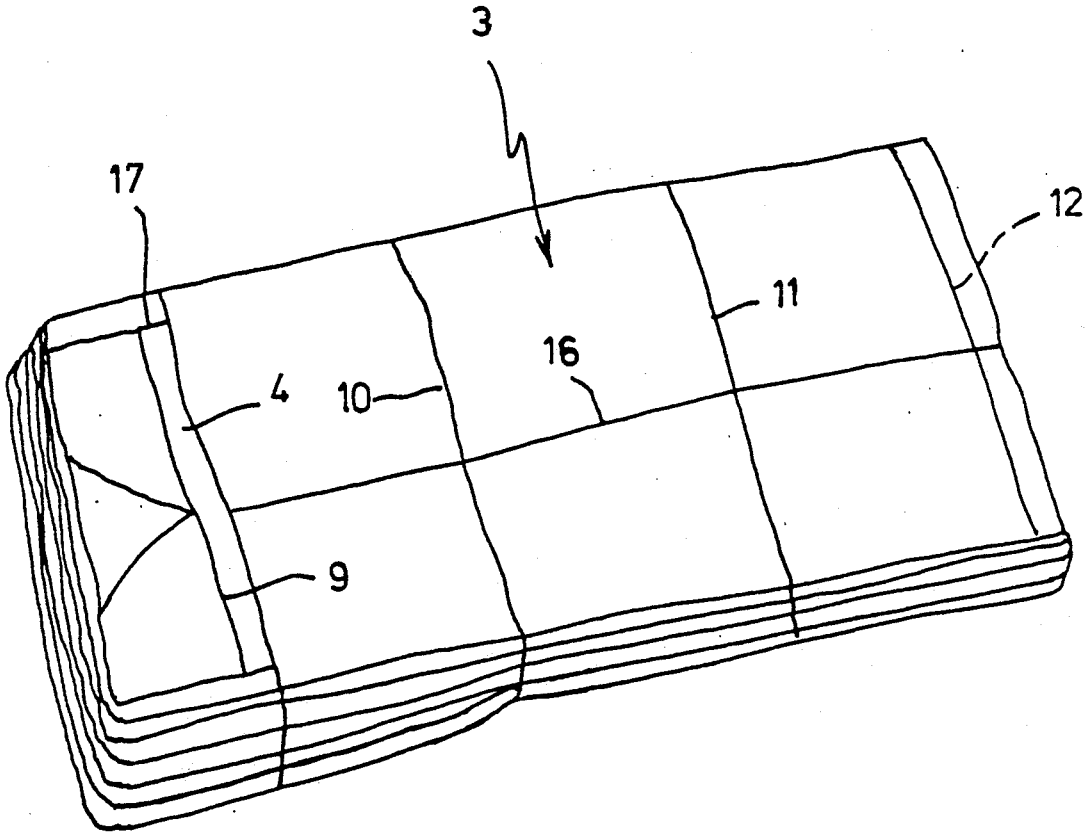

The invention relates to a container made up like an envelope, in particular for pulverized and granular products, such as medicines, said container being obtained by folding a stamped blank of paper or similar material and comprising: a front sheet, a back sheet connected therewith by means of a first folding line; a flap connected with the front sheet by means of a second folding line which runs parallel to the first folding line; and side strips which are connected with the front sheet by means of longitudinal folding lines perpendicular to said first folding lines, the edges of the back sheet being adhered thereto by means of a permanent gum path.

A similar container, shaped like an envelope, but having smaller dimensions than usual envelopes, could be used for the packaging of medicinal powders, yet there are some drawbacks. In the first place, envelopes of a known design are insufficiently tight to safely keep medicines, and in the second place an opened envelope of the known design does not lend itself for pouring out medicines, either at once or with breaks.

The object of the invention is to improve on the foregoing. According to the invention this has been achieved in that the front and back sheets are substantially of the same size, and in that two pairs of crease lines have been provided in the sheets, which, after manufacturing the envelope, substantially extend from the centre of the second folding line to the points of intersection of the first folding line with the longitudinal folding lines. After opening the envelope, a parallelogram-shaped "base" can be obtained by folding the crease lines.

The said folding lines are manufactured in the same way though, i.e. by means of a groove die. The crease lines, being of importance to handling are only called like that as distinct from the folding lines, which are necessary for manufacturing the envelope.

The side strips preferably extend in plane form beyond the first and the second folding lines, the portions of the side strips that extend beyond the first folding line being provided with a bevel of substantially 45°.

If the flap is provided with a slightly adhesive gum path on its extreme edge, the envelope can be opened without cutting the second folding line. This flap can be of at least substantially the same size as the front and back sheets, however, it could also be substantially three times the size of the front and back sheets. In the latter case the flap has a so-called pouring-out facility.

Preference is given to providing the gum path at that side of the flap which will not be in contact with the product during pouring out.

In order to improve the tightness, the front sheet may comprise a sealing edge. This sealing edge may comprise two grooves which adjoin the side strips of the completed container. This feature is beneficial to obtaining a somewhat larger opening than the one which appears from an embodiment without grooves. One could call it a better 'dip in possibility' when dipping a wet finger in the container.

If a crease line has been provided in the flap, halfway its width, the pouring out may occur even more efficiently.

The containers of the invention are preferably put on the market in the format of a stack, in which the envelopes are connected with each other by means of the slightly adhevise gum path.

The invention will be further elucidated hereinafter on the basis of the drawing, in which, by way of example, a plane of an envelope according to the invention has been illustrated. In this drawing folding lines have been indicated by means of broken lines and crease lines by means of uninterrupted lines.

The plane for the invented envelope comprises a front sheet 1, a back sheet 2, a flap 3, being thrice the size of the front and back sheets, a sealing edge 4, and two side strips 5 being covered by a permanent gum path and being connected with the back sheet 2 and the adjacent parts of the front sheet 1 and the flap 3 by means of longitudinal folding lines 6. The part of the side strips 5 adjacent to the front sheet is provided with a bevel 5' of 45°.

Upon manufacturing the envelope, firstly the front sheet 1 is folded round a first folding line 7 against the back sheet 2 (arrow A). Secondly, the side strips 5, being covered with a permanent gum path, are folded against the front sheet 1 (arrows B). After filling the envelope, the flap 3 can be folded round a second folding line 8, which actually is a crease line, onto the front sheet 1.

It is remarked that the first and second folding lines 7 and 8 extend in plane form through the side strips 5, and that during the folding round the second folding line 8, a crease line, arranged for that purpose, merges into a third folding line 9 which bounds the sealing edge 4. By means of the sealing edge 4 and the bevel 5', a sufficiently tight envelope is obtained.

If, as indicated, the flap 3 is thrice the size of the front and back sheets 1 and 2, two additional crease lines 10 and 11 can be arranged in the correct positions, which facilitate the doubling, yet this is not essential. Anyway, it is an object of the invention to put envelopes on the market made up like a stack, of which the seperate envelopes are connected with each other via a slightly adhesive gum path 12 that is arranged on the extreme edge of the flap 3. Consequently, the envelope can be opened without any damage and, if desired, can be closed afterwards. However, the gum path 12 may not come into contact with the product during pouring out. This can be achieved by extending the flap 3 and providing the gum path at the reverse side.

The most important detail of the envelope of the invention is that two pairs of crease lines 13 extend in the manufactured envelope between the centres 14 of the folding lines 8 and 9 and that the points 15 of the first folding line 7 are located at the boundaries of the front and back sheets, i.e. in the points of intersection 15 of the first folding line 7 and the longitudinal folding lines 6.

Upon arranging these crease lines 13, a user of the envelope is enabled to put down the envelope on a parallelogram-shaped base, after opening and folding back the flap 3. This is achieved by bending the envelope with two fingers after folding back the flap, as it were, by urging the points of intersection of the second/-third folding lines 8/9 and the longitudinal centre lines 6 towards each other with the thumb and a finger. If, in addition, a crease line 16 is arranged in the flap 3 halfway its width, furthermore, a spout is provided for pouring out a pulverized or granular contents of the envelope in a rather convenient manner.

Besides, the sealing edge 4 can be provided with two grooves 17 which adjoin the side strips 5 of the completed container. This also promotes the facility of pouring out the envelope.

Embodiments, different to the one as illustrated in the drawing, do fall within the scope of the claims, in which different relations between width and height of the front and back sheets are being thought of in particular.

I claim:

1. Container made up like an envelope, obtained by folding a stamped blank of sheet material and comprising:

a front sheet;

a back sheet connected therewith by means of a first folding line;

a flap having extreme edges and sides connected with the back sheet by means of a second folding line having a center which runs parallel to the first folding line, said flap at least partly overlapping the front sheet;

side strips which are connected with the back sheet by means of longitudinal folding lines perpendicular to said first folding line, the edges of the front sheet being adhered thereto by means of an adhesive path, wherein said front and back sheets are substantially of the same size, and wherein two pairs of crease lines have been provided in these sheets, which crease lines, after manufacturing of the envelope, substantially extend from the center of the second folding line to points of intersection of the first folding line with the longitudinal folding lines; and the flap having a slightly adhesive path on the extreme edge thereof.

2. Container according to claim 1, wherein said side strips extend in plane from beyond the first and the second folding lines, portions of the side strips that extend beyond the first folding line being provided that a bevel of substantially 45°.

3. Container according to claim 1 wherein the flap is at least the same size as the front and back sheets.

4. Container according to claim 1, wherein the adhesive path is provided at one or both sides of the flap, which will not be in contact with a product during pouring out of the product.

5. Container according to claim 1, wherein the front sheet comprises a sealing edge.

6. Container according to claim 5, wherein the sealing edge comprises grooves which adjoin the side strips of a completed container.

7. Container according to claim 1 wherein a crease line has been arranged to bisect the flap along its length.

8. A plurality of containers in the form of envelopes according to claim 1 wherein the containers are connected with each other by means of their respective slightly adhesive paths.

* * * * *